US005287804A

United States Patent [19]

Compagnone

[11] Patent Number: 5,287,804

[45] Date of Patent: Feb. 22, 1994

[54] MECHANICAL SYSTEM FOR DISPLACING MODULAR PLATFORMS FOR FITTING OUT MULTI-PURPOSE HALLS

[76] Inventor: Rocco Compagnone, 4, rue Frederic Sauton, 75005, Paris, France

[21] Appl. No.: 709,326

[22] Filed: Jun. 3, 1991

[30] Foreign Application Priority Data

Jun. 6, 1990 [FR] France ..... 90 07015

[51] Int. Cl.[5] ..... A47B 9/00

[52] U.S. Cl. ..... 108/144; 108/147; 240/421

[58] Field of Search ..... 108/144, 145, 147; 248/421, 583, 585; 259/122, 124

[56] References Cited

U.S. PATENT DOCUMENTS

| | | | |
|---|---|---|---|
| 3,025,106 | 3/1962 | Evans et al. . | |
| 3,282,566 | 11/1966 | Clarke | 108/144 X |
| 3,308,485 | 3/1967 | Nesbit-Evans | 108/147 X |
| 4,558,648 | 12/1985 | Franklin et al. | 108/144 X |
| 4,577,821 | 3/1986 | Edmo et al. | 108/147 X |
| 4,681,292 | 7/1987 | Thomas | 248/421 X |
| 4,682,750 | 7/1987 | Rudolph et al. | 108/147 X |
| 4,712,653 | 12/1987 | Franklin et al. | 108/145 X |
| 4,718,355 | 1/1988 | Houghton | 108/144 X |
| 4,754,713 | 7/1988 | Chatenay . | |
| 4,854,092 | 8/1989 | Chatenay . | |

FOREIGN PATENT DOCUMENTS

| | | |
|---|---|---|
| 184611 | 11/1905 | Fed. Rep. of Germany . |
| 1213590 | 3/1966 | Fed. Rep. of Germany . |
| 2507655 | 3/1982 | France . |
| 2587784 | 3/1987 | France . |
| 271402 | 6/1988 | France . |
| 2614348 | 10/1988 | France . |

*Primary Examiner*—Jose V. Chen

*Attorney, Agent, or Firm*—Fisher, Christen & Sabol

[57] ABSTRACT

A mechanical system constituting a modular driving unit for the programmed displacement of a mobile structure with respect to a reference bearing plane, the structure remaining parallel to itself. The mechanical system includes a frame formed by at least two lateral sides connected together. The frame is fast with the mobile structure. There is a principal upright articulated on the frame by a first end, with the second, opposite end resting on said reference bearing plane. There is also a maneuvering jack articulated by one end on the frame and by the opposite end on the second end of upright. Maneuver of the jack allows the angular displacement of the upright. The assembly of the upright and the jack constitutes with the frame a deformable triangle. A transmission assembly is borne by the frame and is constituted: (i) by a longitudinal shaft located in a plane parallel to the plane of displacement of the jack (ii) by a transverse shaft at right angles to the longitudinal shaft, and (iii) by a pinion controlling maneuver of the jack, the two shafts being kinetically connected together and connected to the pinion.

11 Claims, 13 Drawing Sheets

MECHANICAL SYSTEM FOR DISPLACING MODULAR PLATFORMS FOR FITTING OUT MULTI-PURPOSE HALLS

FIELD OF THE INVENTION

The present invention relates to a mechanical system for the programmed displacement of a mobile structure having to remain parallel to itself all along its displacement.

This invention also concerns a modular structure incorporating this mechanical system and adapted to constitute, by assembling a plurality of modules, an overall structure, in particular a platform mobile in height.

The invention is further applicable to the production of superstructures formed by combining platforms to fit out multi-purpose halls.

The present invention is particularly applicable to mobile platforms adapted to be displaced, whilst remaining in a horizontal plane, between a lower retracted position and an elevated position at an adjustable height.

BACKGROUND OF THE INVENTION

Such platforms are used in particular for fitting out collective multi-purpose halls especially intended for public or private events. In accordance with presently known techniques, such multi-purpose halls are fitted out with a plurality of platforms positioned contiguously, each platform comprising elevator means for positioning it at a suitable height.

Devices of this type make it possible to fit out a large multi-purpose hall which may be used for various public or private activities.

The hall may thus be totally cleared for a standup event, in which the participants must move from one place to another, whilst, by extending into steps, an auditorium can be produced, whose shape, dimensions and configuration are adapted to the entertainment offered, whether it be question of positioning the spectators with respect to a stage, or of enabling them to watch a sporting event (tennis, boxing or the like) taking place at the centre of the hall.

In the devices of this type, it is necessary to maintain constant the horizontality of the platforms.

It is therefore necessary to ensure perfect synchronization between the elevator devices, particularly the jacks, so as to avoid any distorsion.

It is a principal object of the present invention to ensure a strictly and constantly horizontal position of the platform under perfectly reliable conditions and by employing particularly economical means.

It is another object of the invention to ensure, in addition to a constant horizontality during the movement of elevation or of lowering, a perfect stability of the platform both in the vertical plane and in the horizontal plane.

It is a further object of the invention to produce platforms of any dimensions and configurations, without dimensional limitation, the structural and kinetic homogeneity of the platform, as well as its stability, being ensured under totally reliable conditions.

SUMMARY OF THE INVENTION

The present invention relates to a mobile platform adapted to be displaced, whilst remaining in a horizontal plane, between a lower retracted position and an elevated position at an adjustable height, wherein it comprises at least two mechanical systems constituting a modular driving unit for the programmed displacement of a mobile structure with respect to a reference bearing plane, the structure remaining parallel to itself, and wherein said mechanical system comprises:

a) a frame formed by at least two lateral sides connected together, the frame being fast with said mobile structure;

b) a principal upright articulated on said frame by a first end, the second, opposite, end resting on said reference bearing plane;

c) a manoeuvring jack articulated by one end on said frame and by the opposite end on the second end of said upright, manoeuvre of the jack allowing the angular displacement of the upright, and the assembly of the upright and the jack constituting with the frame a deformable triangle;

d) a transmission assembly borne by said frame and constituted: i) by a longitudinal shaft located in a plane parallel to the plane of displacement of the jack, ii) by a transverse shaft at right angles to the longitudinal shaft, iii) by a pinion controlling manoeuvre of the jack, the two shafts being kinetically connected together on the one hand and connected on the other hand to said pinion, and either shaft being likely to be connected to actuating means.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
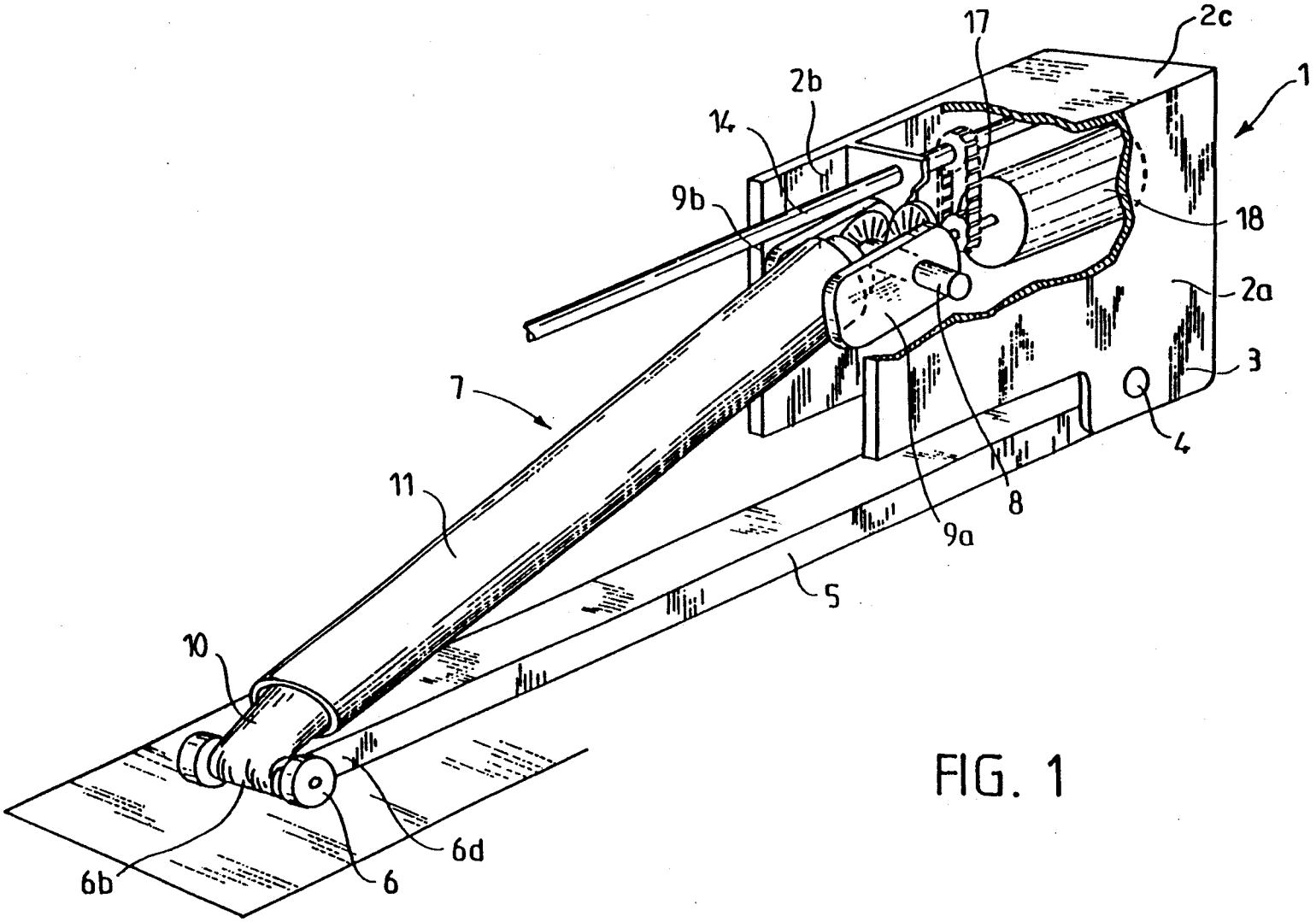
FIGS. 1 and 2 represent a mechanical system, in the present case motorized, used for the displacement of a platform with respect to a reference bearing plane, the assembly being shown in retracted position in FIG. 1 and in extended position in FIG. 2.
Figure 2:
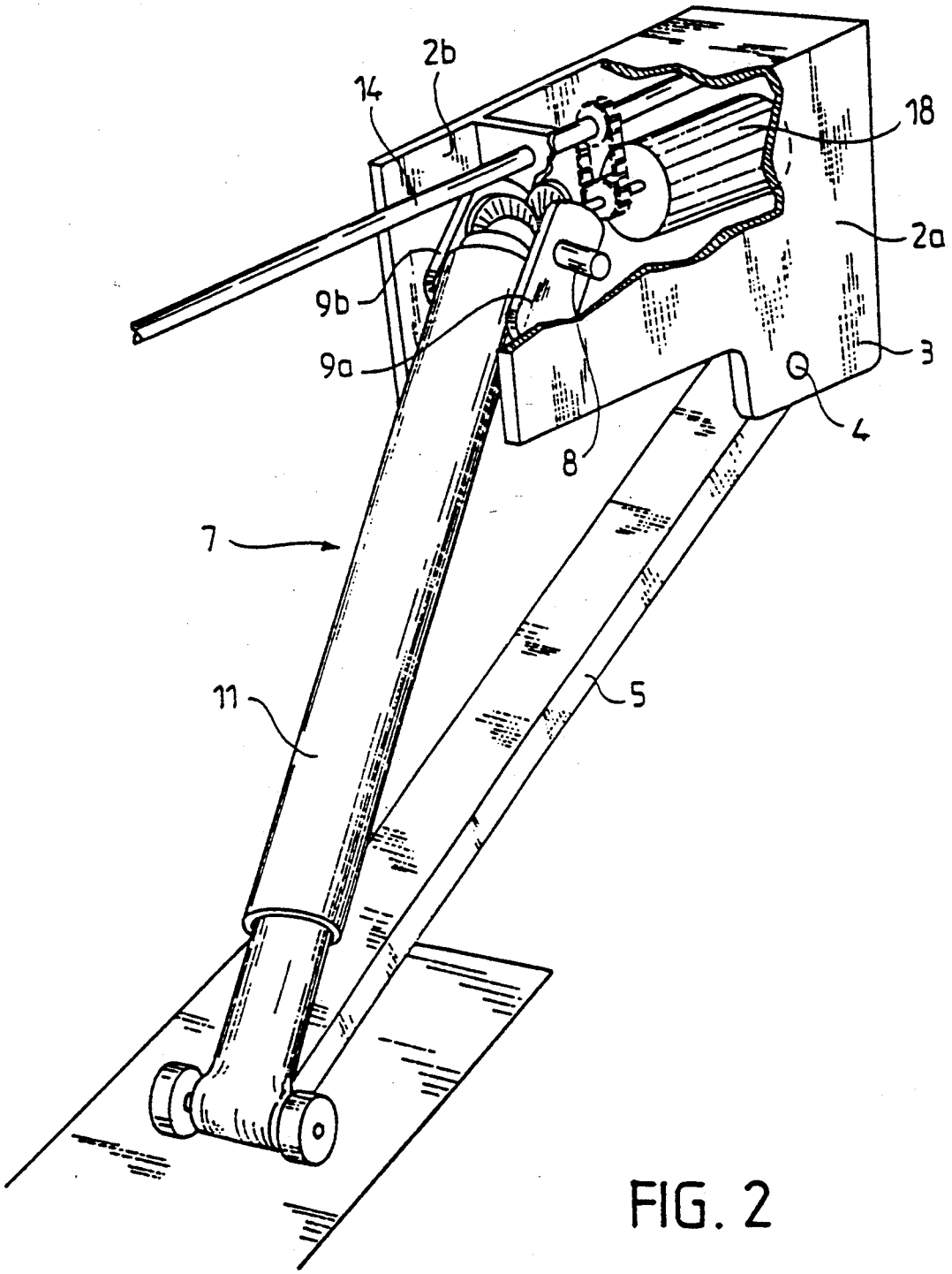

Referring now to the drawings, the mechanical system constituting a kinetic unit according to the invention is shown in perspective in FIGS. 1 and 2 and it is composed of a frame 1 formed in particular by two lateral sides 2*a* and 2*b* joined at their apices by an upper spacer member 2*c*.

Each of the sides is extended at its base by a cheek 3 serving as console for receiving the articulation 4 of a principal upright 5 pivotally mounted at 4 on the frame 1; the free end of the upright 5 is provided with rolling means 6 resting on a bearing plane, the floor in the present case.

The upright 5 may be displaced angularly by the action of the jack 7 itself pivotally mounted on frame 1 via the transverse shaft 8 belonging to a transmission assembly integrated within the frame 1.

Figure 7A:
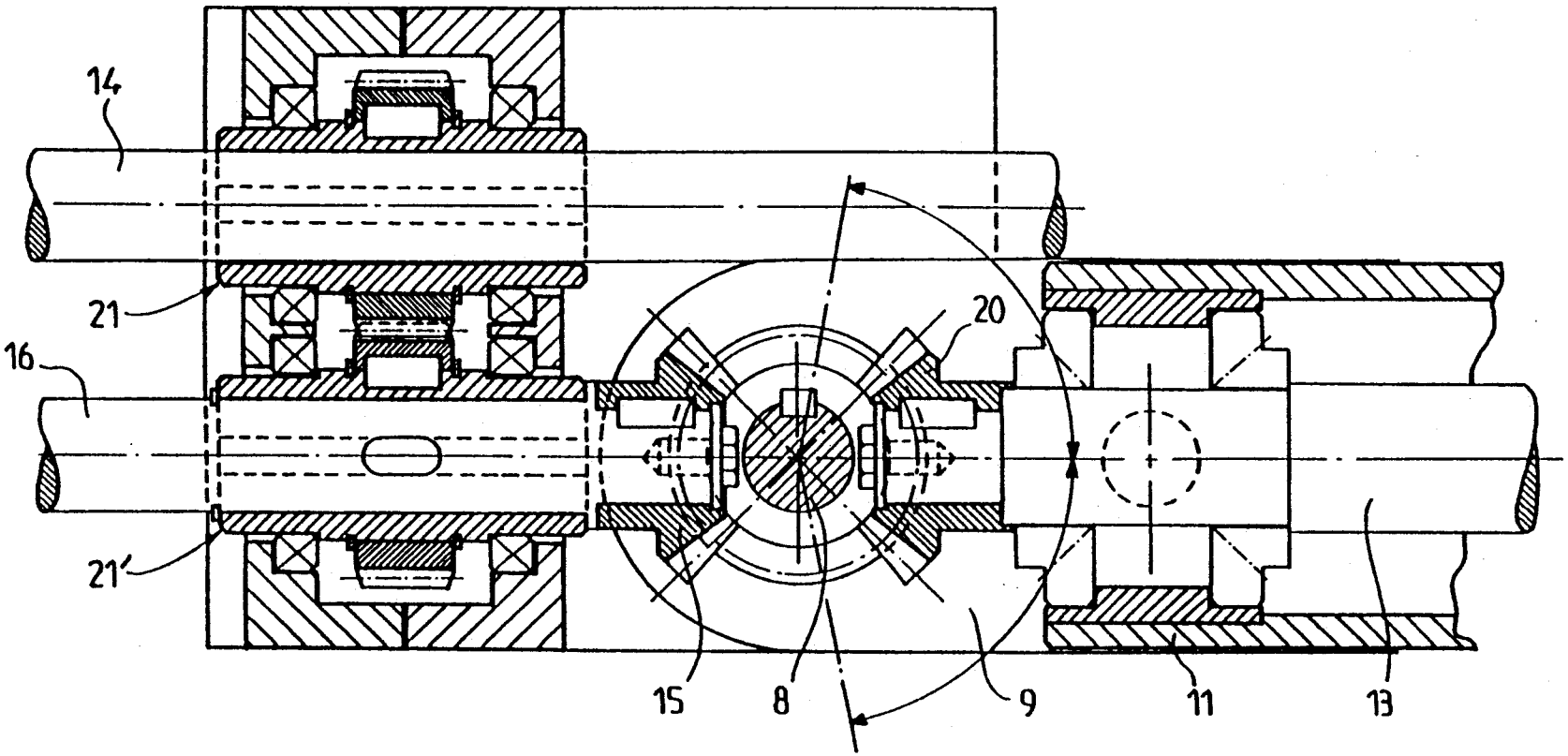
FIG. 7*a* a view in section of a transmission assembly in the mechanical system.
Figure 7B:
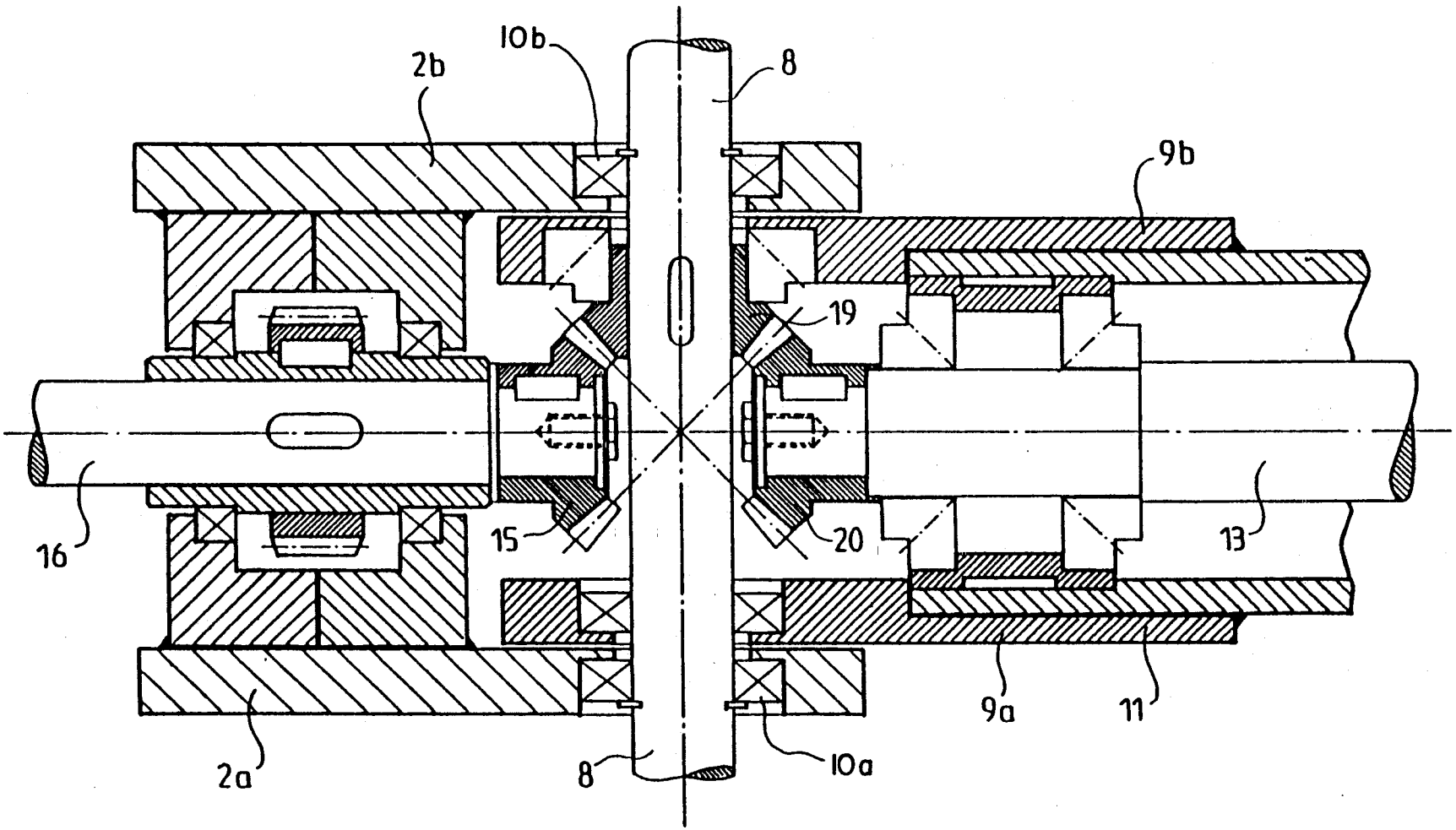
FIG. 7*b* shows a plan view of this same transmission assembly.

This transmission assembly is shown in greater detail in vertical section in FIG. 7*a* and in plan view in FIG. 7*b*.

The pivot pin of the apex of the jack 7, via the two lateral lugs 9 and 9', is constituted by the transverse shaft 8 which is mounted in a roller bearing 10*a*, 10*b* disposed in the sides 2*a* and 2*b*.

The jack for manoeuvring and extending the upright is itself constituted by an outer sleeve 11 internally containing a piston 12 adapted to be telescopically displaced inside the sleeve 11 by the action of an endless screw 13 driving a captive nut (not shown) and fast with the head of the piston.

The endless screw 13 is actuated by the transmission assembly described hereinafter.

This assembly, illustrated in FIGS. 7*a* and 7*b*, comprises, according to the invention, two drive shafts disposed at right angles and both capable of performing the role of driving shaft.

The mechanical system, particularly of FIG. 1, comprises a longitudinal shaft 14 which will serve, as will be set forth hereinafter, for coupling platforms made from the kinetic system according to the invention, and abutting together.

The kinetic system comprises a transverse shaft 8 mentioned hereinabove, at right angles to the longitudinal shaft 14.

The transmission assembly allowing transmission of the movement either from longitudinal shaft 15 or from transverse shaft 8, to the jack is constituted by a first truncated pinion 15 mounted at the end of the secondary shaft 16 itself kinetically connected, for example by the chain 17, to the longitudinal shaft 14.

In FIGS. 1 and 2, the secondary shaft 16 is a driving shaft; it is in fact mounted at the end of the driven shaft of the motor 18.

It should be understood that this construction corresponds only to a particular case in which the mechanical system presents its own independent motorization means constituted by the motor 18 integrated inside the frame 1.

According to FIGS. 7*a* and 7*b*, the truncated pinion 15 gears on the intermediate pinion 19 keyed on shaft 8, which intermediate pinion 19 in turn engages on the third pinion 20 mounted at the end of the endless screw 13.

It is thus seen that the driving movement may come either from the longitudinal shaft 14 or from the transverse shaft 8, the transmission to the truncated pinion 20 being effected in any case.

In addition, whatever the driving input, the transmission assembly integrated in the mechanical system of the invention ensures in any case that the other, potential input then performs the role of intermediate transmission.

In fact, it will be understood that, if shaft 8 is provided to be driving (being coupled to a driving member), the transmission assembly will then ensure transmission of the movement not only to the head of the endless screw 13 but also via pinion 15 to the shaft 16 which transmits it via the belt or chain 17 to the longitudinal shaft 14.

Inversely, if a driving member is mounted on the longitudinal shaft 14, the transmission in the opposite direction will necessarily arrive at shaft 8 which, apart from ensuring transmission of the movement to the endless screw, will itself be driven and will thus be adapted to retransmit the movement along an axis at right angles to the longitudinal axis.

It will be noted that the transmission between the secondary shaft 16 and the longitudinal shaft 14 may be effected by any means; whereas in FIG. 1 a chain- or belt-transmission has been shown, FIG. 7*a*, which represents a view in vertical section of the transmission assembly, shows the transmission between the secondary shaft 16 and the longitudinal shaft 14 as a set of coupling pinions 21, 21'.

Figure 3:
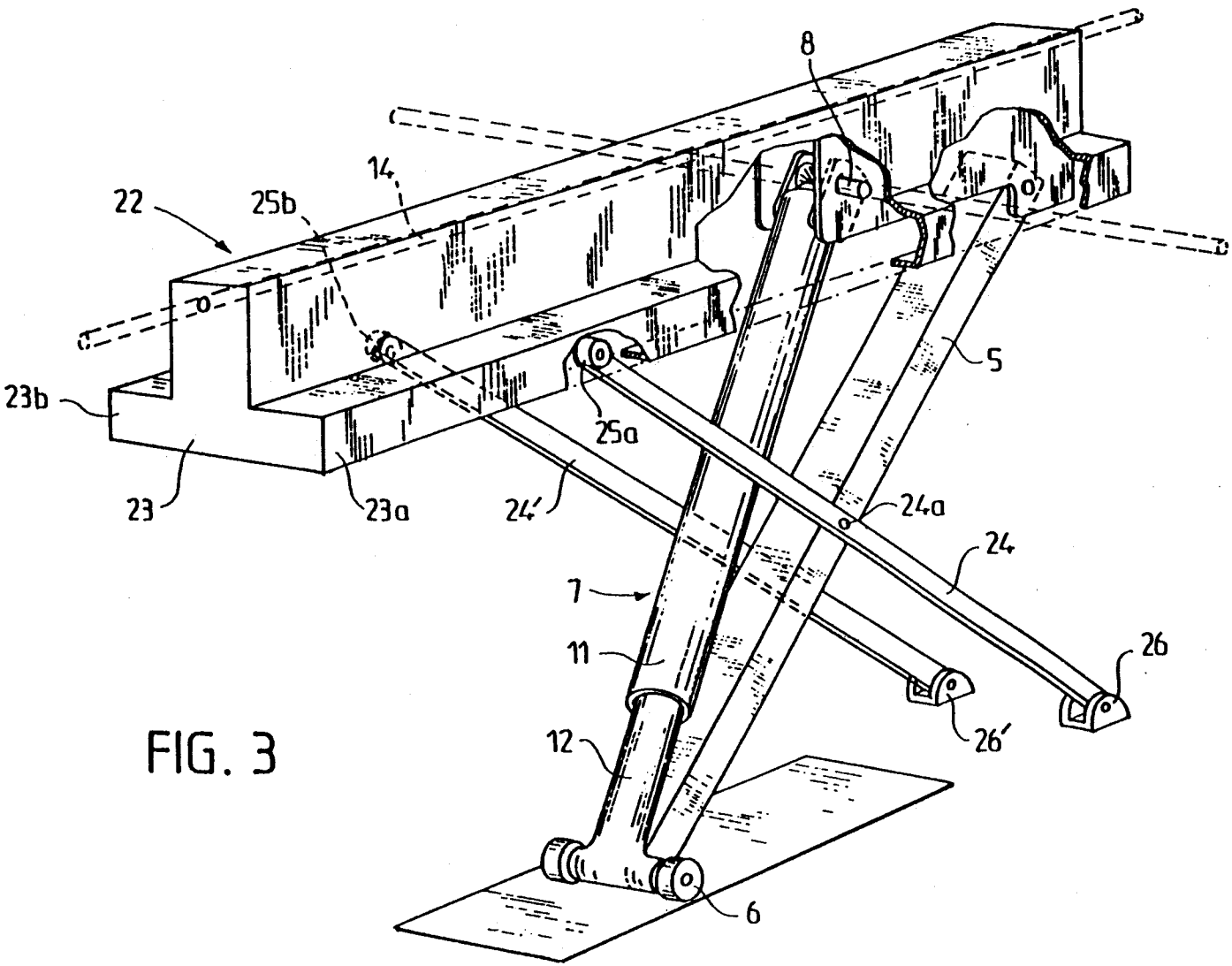
FIG. 3 shows a perspective view of a bearing structure formed by a modular system which may be employed for forming mob platforms and integrating the mechanical 1 and 2.

The kinetic assembly constituted by the mechanical system of FIGS. 1 and 2 may, according to a development of the invention, advantageously be integrated within a platform unit as shown in FIG. 3.

This modular bearing unit integrates the mechanical system described hereinbefore and particularly the supporting frame 1, the principal upright 5 and the jack 7.

On this mechanical assembly there is mounted a reinforcement constituted by a longitudinal beam formed by a box girder 22 whose median axis is disposed in a plane parallel to the planes of displacement respectively of the articulated principal upright 5 and of its manoeuvring jack 7.

In order to complete homogeneity and control of the assembly in this embodiment, the principal upright 5 is associated with two lateral bracing uprights 24, 24' respectively.

The box girder 22 has a cross section 23 generally in the form of an upturned T of which the lateral flanges 23*a* and 23*b* constitute a longitudinal member defining, by a U-profile turned towards the inside of the beam, a rail for guiding the rollers 25*a* and 25*b* respectively disposed at the apices of the bracing uprights 24, 24'.

In this embodiment, the base of the bracing uprights 24, 24' may be articulated at 26, 26' on bearing brackets disposed on the floor, thus ensuring the strictly constant positioning of the box girder 22 parallel to itself in all the phases of elevation or of descent of the assembly.

It is seen that a repetitive platform or module is thus produced which is capable of being coupled to identical modules in order to form a perfectly homogeneous overall superstructure whose movement will thus be automatically synchronized.

Each module comprises per se all the means ensuring stability and independence thereof in all positions.

Figure 4A:
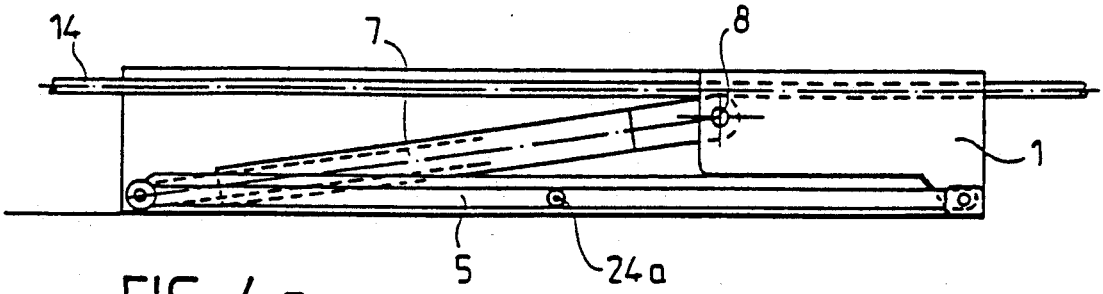
FIGS. 4*a* and 4*b* show a bearing structure constituting a modular unit according to FIG. 3, shown in side elevation, respectively in retracted position in FIG. 4*a* and in elevated, or extended, position in FIG. 4*b*.
Figure 4B:
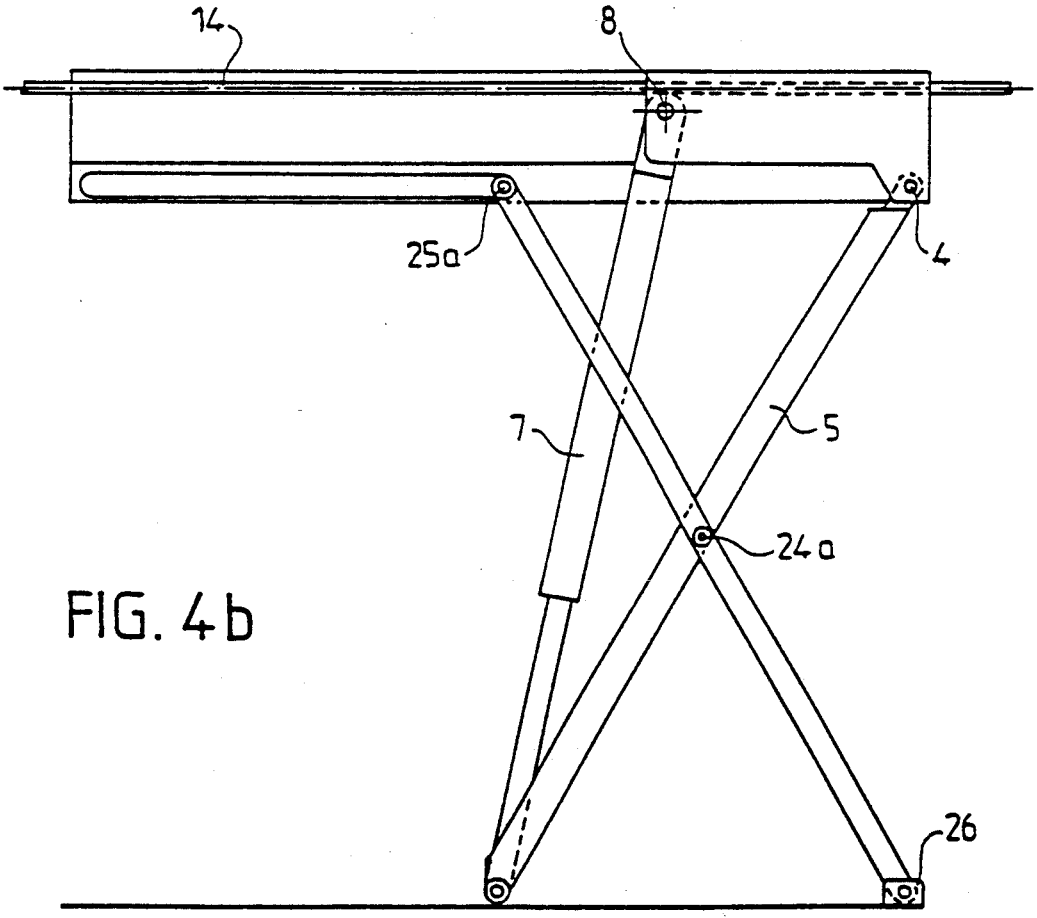

FIGS. 4*a* and 4*b* schematically show the kinetics of each module and its possibilities of displacement in height under the action of jack 7, whichever of the inputs (longitudinal shaft 14 or transverse shaft 8) ensures transmission of the movement towards the jack.

It will be readily understood that the transmission assembly described previously and illustrated in FIGS. 7*a* and 7*b*, allows a regular transmission of the movement to the endless screw which itself actuates the jack whatever the angular positions of the latter, between the two extreme angular positions shown in FIG. 4*a* and corresponding to the compacted and retracted position of the deformable triangle formed by the frame 1, the principal upright 5 and the jack 7, and the angular position shown in FIG. 4*b* corresponding to the maximum development of this deformable triangle.

In this position of maximum extension corresponding to the elevation of the module or of the platform, the jack remains positioned in a direction forming an angle greater than 90°.

In fact, it will be understood that, for a vertical position corresponding to a value of the angle of 90°, there would be a risk of arriving in a blocked position.

The movement of the jack during elevation, in the example described, is made in a movement of thrust and of extension; the traction made by the principal upright 5 forming tie-rod provokes deformation of the deformable triangle composed of frame-upright-jack (corresponding to resistant-pulling-pushing triad), until the position of maximum extension is attained which may be limited by conventional stor means; for example, the lateral bracing uprights 14, 14' and more especially their guide rollers 15, 15' may then come into position of abutment on a stop disposed inside their guide rails constituted by the longitudinal members 23*a*, 23*b*.

Figure 5A:
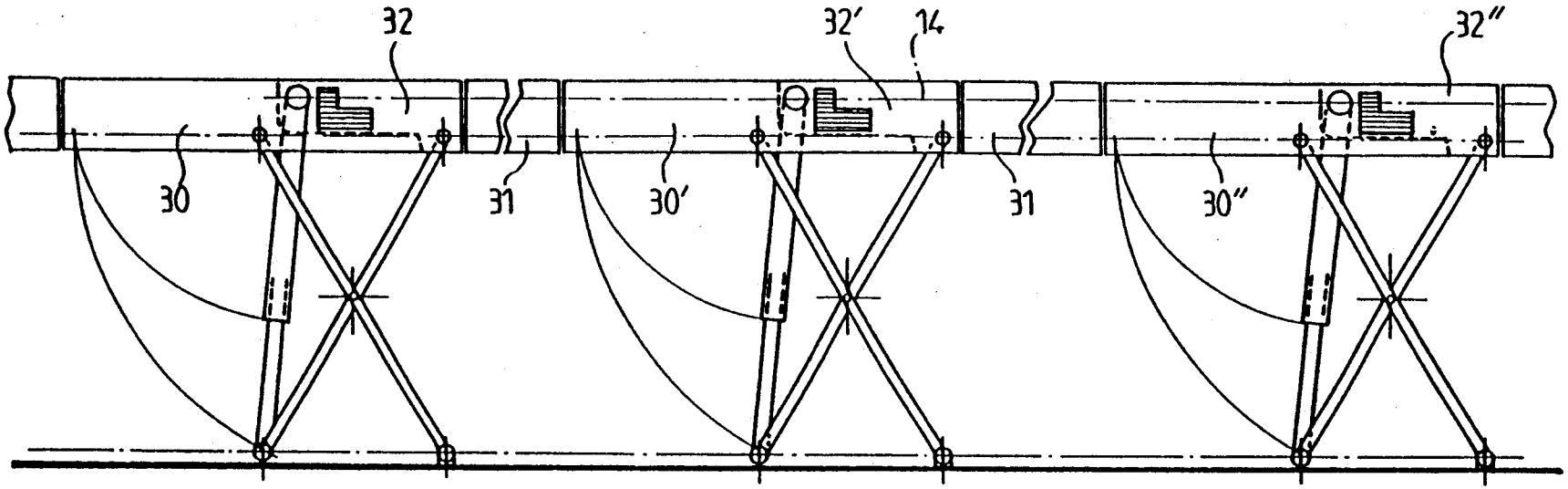
FIG. 5*a* shows a schematic view in side elevation of a platform produced from modular elements of FIGS. 3 and 4 and assembled in colinear manner, FIG. 5*b* showing a of the platform of FIG. 5*a*.
Figure 5B:
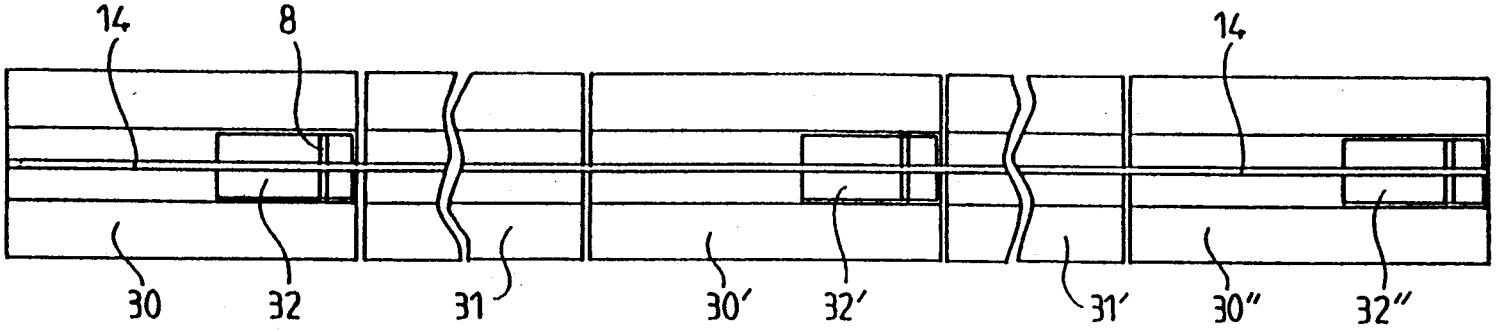

It is seen that the invention, according to FIGS. 5*a* and 5*b*, enables mobile platform assembly to be produced by assembling a plurality of platforms, each forming a module shown in FIG. 3.

FIG. 5*a* shows modules 30, 30', 30" which abut on one another via intermediate neutral modules 31, 31'.

The intermediate neutral modules 31, 31' may be constituted in particular by a simple box girder 22 not presenting any kinetic assembly as shown in FIG. 1, each box girder 22 of the intermediate neutral module 31' thus being connected at each end to the box girders of the active modules 30, 30', 30".

However, each intermediate neutral module 31, 31' presents, longitudinally, a shaft 14 which thus makes it possible to connect the longitudinal shafts 14 belonging to the assembly of the active modules 30, 30', 30".

The platform assembly, constituted by the assembly of the active modules 30, 30', 30" and the intermediate modules 31, 31', thus forms a monobloc assembly by the connection of the box girders of which they are composed.

In addition, this monobloc assembly is kinetically homogeneous and acts as an overall unit insoafar as all the mechanical systems 32, 32', 32" which are integrated in modules 30, 30', 30" are connected together by the longitudinal shaft elements 14 running colinearly over the whole of the platform.

Under these conditions, the actuation of this driving input constituted by the longitudinal shaft 14 automatically affects the assembly of the manoeuvring jacks belonging to the mechanical systems 32, 32', 32" which will thus be moved in a perfectly synchronous movement, ensuring displacement in height of the whole of the platform remaining perfectly parallel to itself and constantly following a horizontal plane.

Figure 6:
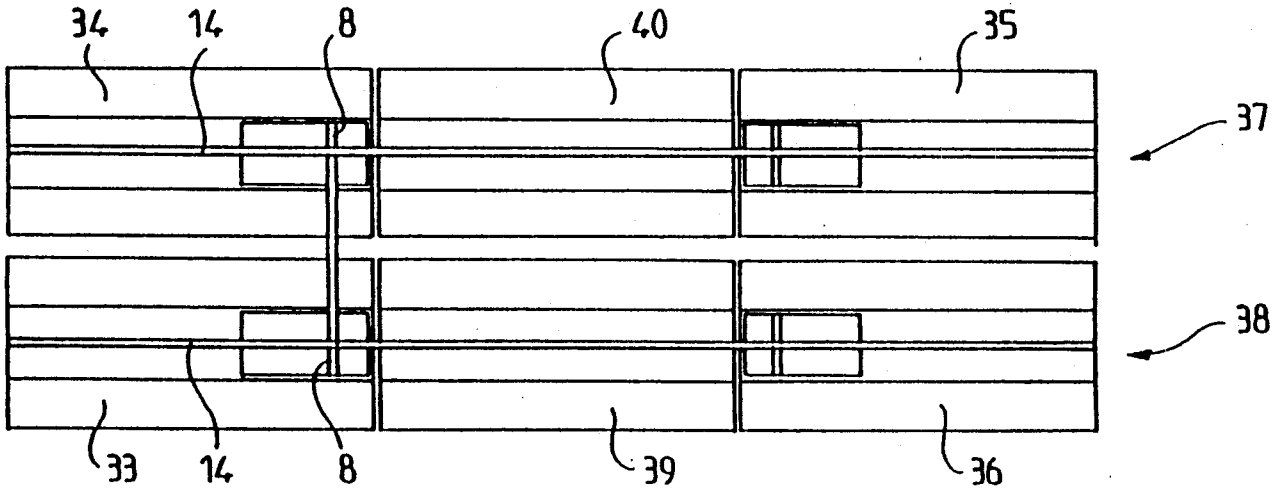
FIG. 6 shows a variant in which a platform assembly comprises a plurality of platforms or modules assembled in first and second colinear rows, the two rows being disposed in adjacent manner and kinetically connected other to form an assembly homogeneous displacement.

FIG. 6 shows a variant embodiment of a platform assembly made from the modules of the invention.

According to FIG. 6, four active driving modules 33, 34, 35 and 36 have thus been assembled, in two rows 37 and 38.

In each of rows 37 and 38, a neutral module 40 and 39 is respectively sandwiched between two active modules.

In each of rows 37 and 38, respectively, modules 34 and 35, on the one hand, and 33 and 36, on the other hand, respectively, are thus coupled by their longitudinal shafts 14 connected together by the shaft 14 running all along the neutral module 39 or 40.

Consequently, each row will be driven in a synchronous movement, as in the example of FIG. 5*a* or 5*b*.

According to the example of FIG. 6, the modules being disposed side by side, a connection is made between the two transverse shafts 8 belonging to modules 33 and 34, respectively.

Under these conditions, the link 41 connecting the transverse shafts 8 of the two modules 34 and 33 ensures a kinetic connection of the assembly.

The six modules will consequently act as a homogeneous assembly, remaining constantly twinned.

This may be so even without static mechanical connection, i.e. without connection of the two rows 37 and 38 together.

The two rows may be independent of each other; nevertheless, they will be driven in strictly synchronous and parallel movements, with the result that they act as strictly monolithic assemblies, whereas no connection is provided.

Figure 8A:
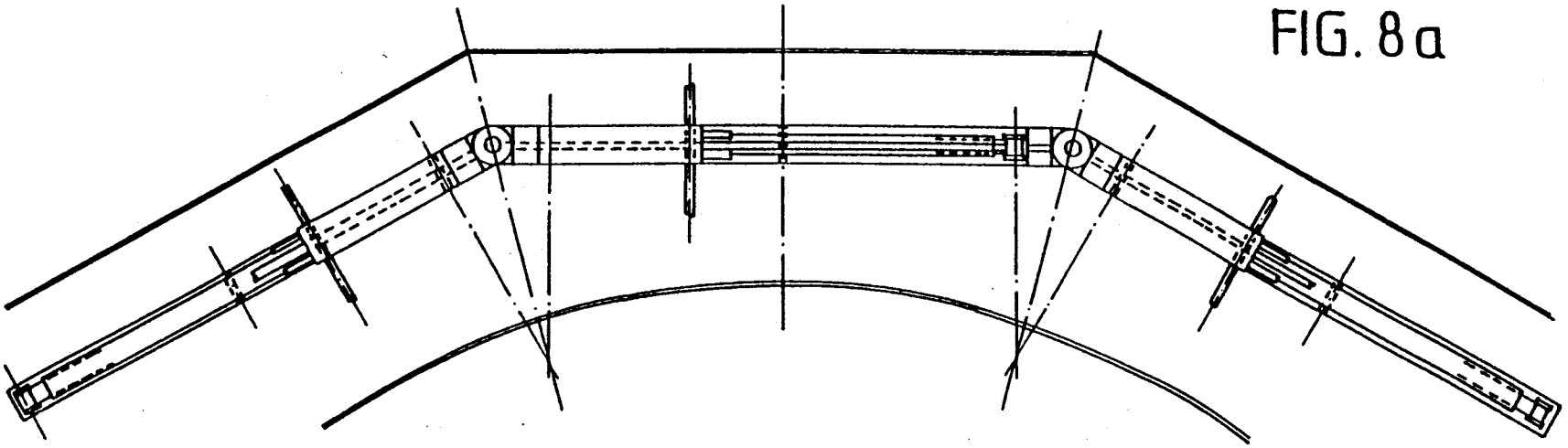
FIG. 8*a* shows a plan view of an assembly of platforms made from modules according to the invention and abutting in non-colinear manner.
Figure 8B:
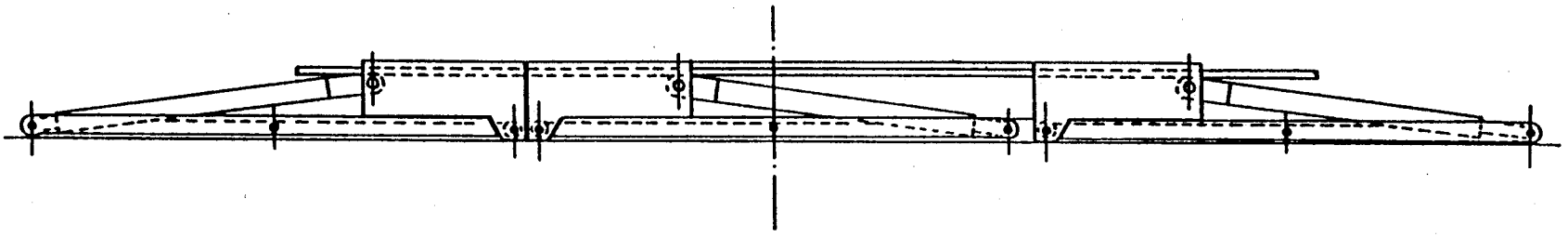
FIG. 8*b* schematically shows the assembly of FIG. 8*a* in side elevation, the platforms being in lowered position.

FIGS. 8*a* and 8*b* show a new development of the invention in which the platform assembly may or may not be constituted by an assembly constituting a unitary, monobloc superstructure, controlled and manoeuvred by a plurality of modules according to the invention and in particular as shown in FIG. 3; the modules being in that case disposed in non-colinear manner in order to follow the shape of the platform assembly, for example a curviform configuration as is the case of FIG. 8*a*.

Figure 9:
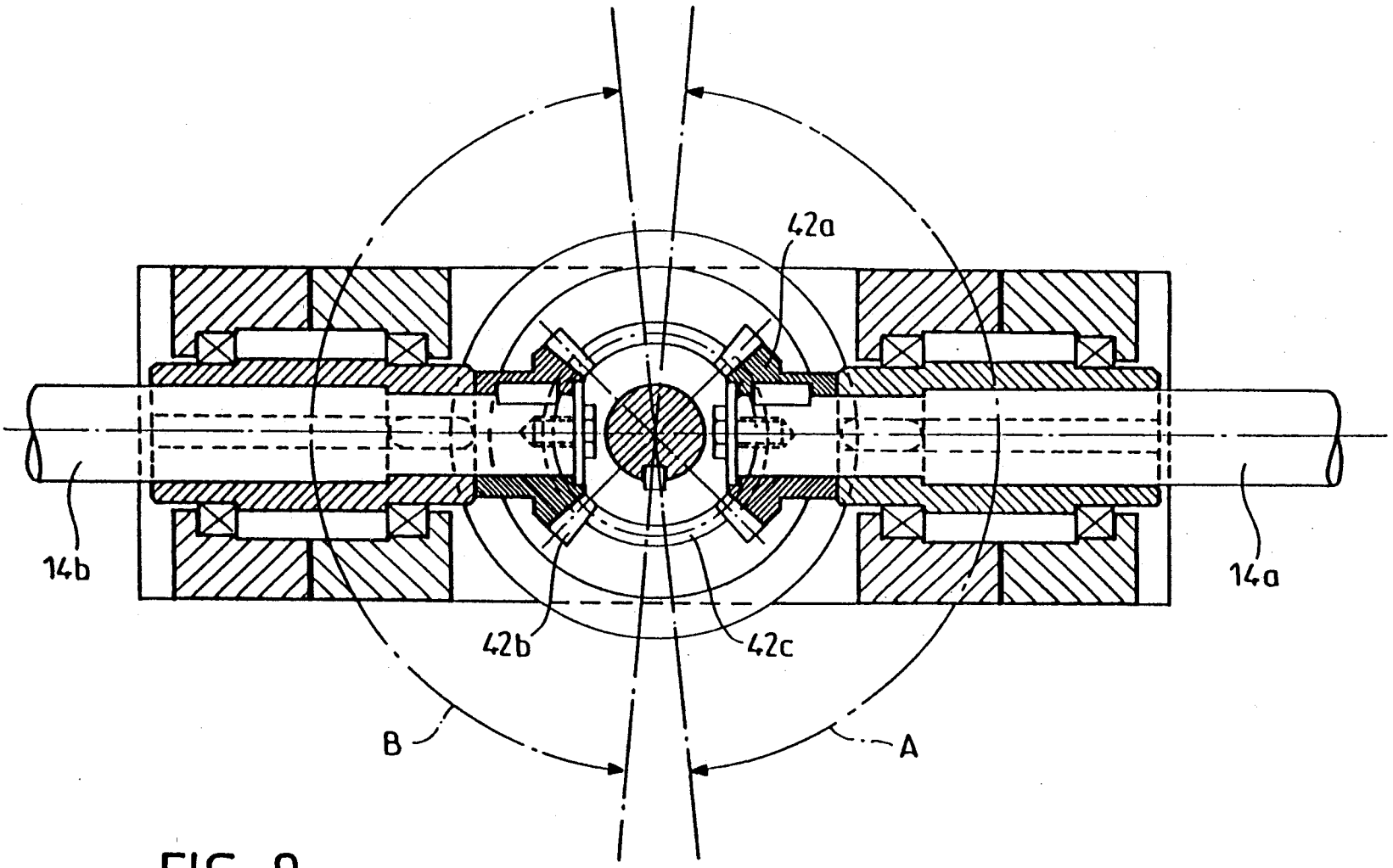
FIG. 9 shows a view of a Universal joint allowing angular transmission between the longitudinal shafts integral two platforms or modules assembled in non-colinear manner.

In that case, the longitudinal shafts 14 are connected by an assembly of angular transmission elements of which the details are shown in FIG. 9.

This Figure shows in plan view the kinetic connection by a Universal joint system, known per se, making it possible to connect the respective movements of the longitudinal shafts 14*a* and 14*b* fast with two modules according to the invention and disposed in non-colinear manner.

In the example illustrated in FIG. 9, the shafts 14*a* and 14*b* are disposed in colinear manner in order to illustrate the invention, it being understood that these shafts may be positioned with respect to each other along arcs of circle A and B respectively.

Each of the longitudinal shafts 14*a* and 14*b* terminates in a truncated pinion 42*a*, 42*b*, which are kinetically connected together by an intermediate pinion schematically shown at 42c, of perpendicular, and in particular, vertical axis in the most usual case where the two longitudinal shafts 14b and 14a are themselves disposed in a horizontal plane.

According to a development of the invention, a platform is provided, of which the structure is independent of the adjacent platform but which is connected thereto by a transmission according to FIG. 9, with the result that the two adjacent platforms, although being independent, may be disposed at a variable angle with respect to one another, whilst remaining kinetically coupled, any driving movement of elevation of one being transmitted to the adjacent platform by the angular transmission means of FIG. 9.

Figure 10:
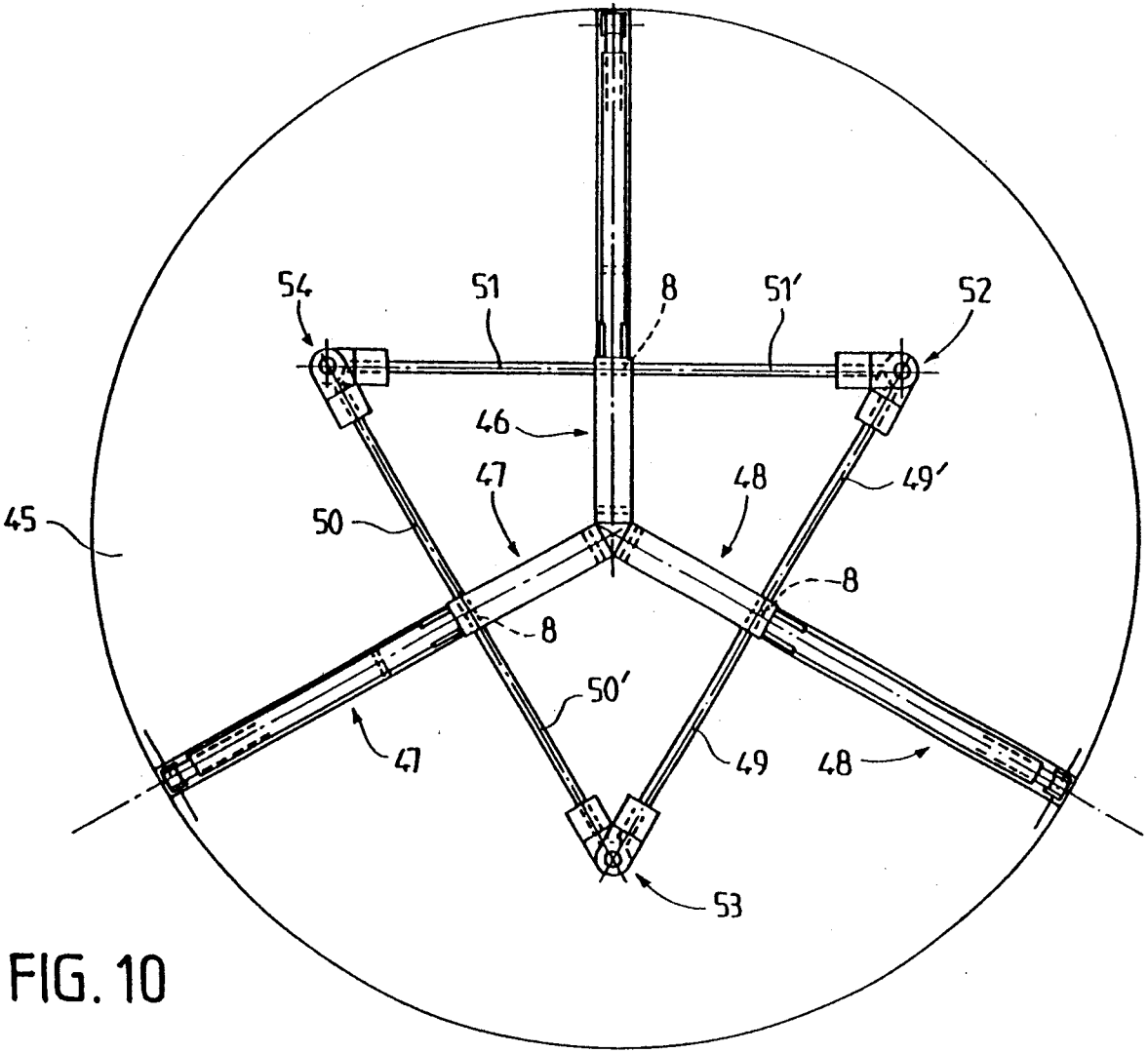
FIG. 10 shows an embodiment of a platform assembly, of circular form, mounted on the mechanical systems of the invention.
Figure 11:
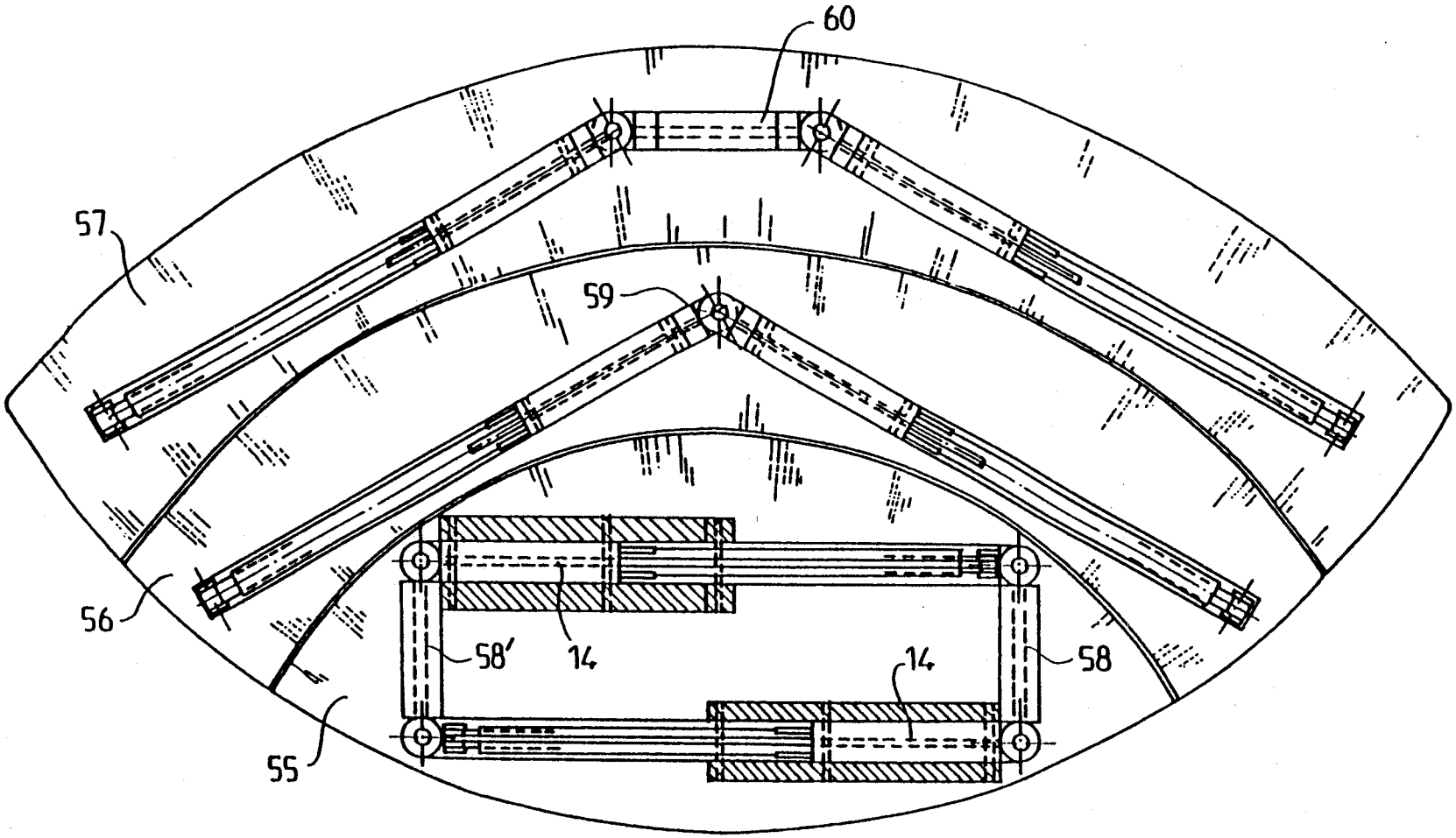
FIG. 11 shows an assembly comprising a plurality of curved platforms disposed concentrically and independently and a central platform, the assembly formed by the platforms being equipped with the mechanical systems according the invention.

Finally, FIGS. 10 and 11 illustrate variant embodiments.

These modules 46, 47, 48 each comprise a transverse shaft 8, as described hereinbefore.

The transverse shafts 8 are connected by connecting shafts 49, 49', 50, 50', 51, 51' themselves kinetically coupled by angular transmission means 52, 53 and 54, as described hereinbefore and shown in FIG. 9.

A circular plateau is thus produced, mounted on a "tripod", each element being constituted by a kinetic system shown in FIG. 1 and thus ensuring the perfectly regular elevation movement of the plateau, the plateau being strictly horizontal in all positions.

FIG. 11 illustrates a variant of the preceding devices, showing the possibility, within the framework of the invention, of producing juxtaposed platforms presenting various geometrical shapes.

This Figure shows a central plateau 55 surrounded by two curviform platforms 56 and 57.

The plateau 55 is equipped with two elevator system according to the invention, disposed head-to-tail and connected to each other at their two ends via the transmission shafts 58, 58' coupling the longitudinal shafts 14 of each of the elevator modules; transmission between the intermediate shafts 58, 58' and the longitudinal shafts 14 being effected by means of the angular transmission means described hereinabove.

The intermediate platform 56, in the form of a segment of ring, comprises two elevator systems according to the invention, which are coupled by the ends of their longitudinal shafts 14 meeting at the Universal joint constituted by the angular transmission means 59, described previously.

The outer platform 57, in the form of a segment of ring, likewise comprises the two elevator systems according to the invention which are coupled together by an intermediate shaft 60 joining, by the angular transmission means previously described, the heads of each of the longitudinal shafts 14 belonging to the two symmetrical elevator systems equipping platform 57.

According to the invention, transmission of the movement from an actuating means may be effected either longitudinally by connection on shaft 14 or transversely by connection on transverse shaft 8.

The invention is therefore applicable to the motorization of any structures adapted to be used for fitting out halls for theatrical purposes or the like or for the three-dimensional arrangement of surfaces, for example of exhibition halls or industrial plants in which working platforms must be displaced successively at different places, at variable heights adapted to the advance of the work.

Figure 12A:
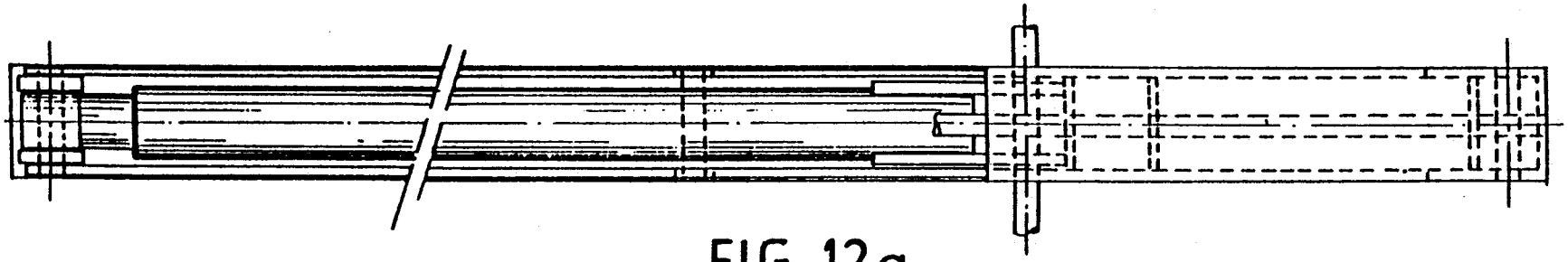
FIGS. 12*a* and 12*b* show variant embodiments incorporating a return spring in the manoeuvring jack.
Figure 12B:
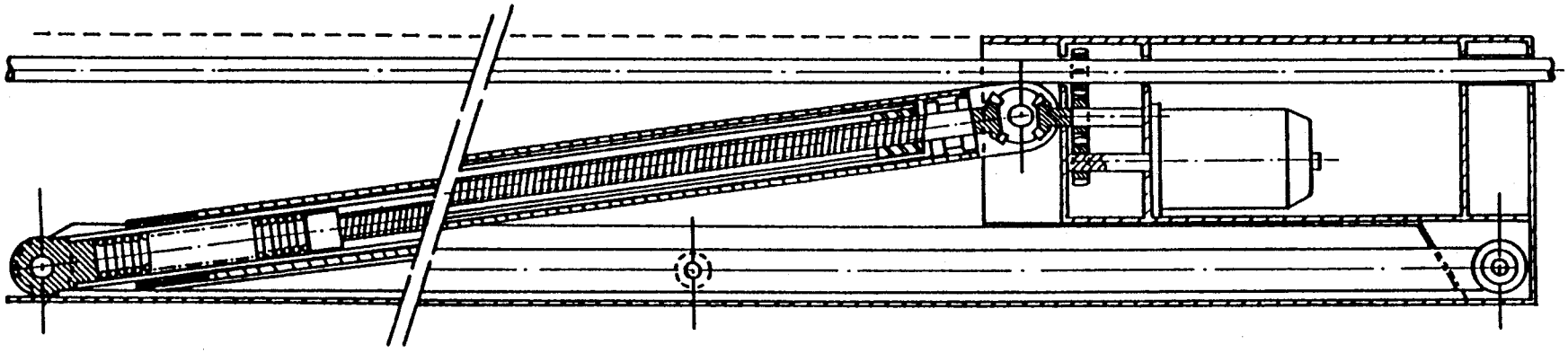

According to FIG. 12, the jack comprises a mechanical pressure accumulation means, such as a spring working in compression or a piston-pushed gas compression chamber, tensioning being effected upon return of the mechanical system into compacted position (or low position when the system works as vertical elevator).

Apart from the fact that this system performs the role of safety damper allowing, in the event of possible failure, a slow-motion lowering of the platform, avoiding any accident, it accumulates upon descent a force restored to the platform during subsequent elevation, in that case facilitating initial start-up.

The force accumulated in the spring may thus be provided to balance the weight of the bare platform and its kinetic unit or units; consequently the motor or motors only raise the superstructures borne by the platform.

According to a development, at least one of the shafts, preferably one of the longitudinal shafts 14, comprises a system, known per se, for controlling end of stroke in the form of a revolution-counter making it possible to remote-control or program the end of any displacement initiated. The shaft may thus comprise, mounted on a threaded part thereof, a cursor, in the form of a captive nut adapted to be displaced between two beginning- or end-of-stroke contactors or associated with an encoder monitoring at any moment the instantaneous position of the assembly and adapted, in accordance with the orders given, to trigger off the signals for switching on or off the motor or motors forming the actuating means.

What is claimed is:

1. A mobile platform adapted to be displaced, while remaining in a horizontal plane, between a lower retracted position and an elevated position at an adjustable height, said platform being constituted by one longitudinal beam, one longitudinal shaft running colinearly over the whole of the beam and at least two driving units, wherein each driving unit comprises:

(a) a frame formed by at least two lateral sides connected together and supporting the longitudinal beam;

(b) a principal upright articulated on the frame;

(c) rolling means provided on the free end of said principal upright and resting on a floor;

(d) a maneuvering jack constituted by:

(i) a telescopic sleeve articulated on said frame, (ii) a movable piston contained inside said sleeve and articulated on the free end of said principal upright, (iii) an endless screw, and (iv) a captive nut fast with the piston;

(e) a secondary shaft parallel to the longitudinal shaft;

(f) transmission means for mechanical connection of the longitudinal shaft and the secondary shaft;

(g) a transverse shaft at right angles to the secondary shaft;

(h) a first bevel pinion mounted on said secondary shaft;

(i) a second bevel pinion mounted on the transverse shaft and gearing on said first bevel pinion;

(j) a third bevel pinion gearing on said second bevel pinion for maneuver of the jack and mounted on said endless screw;

(k) connection means for kinetic connection of a shaft belonging to a mobile platform to a shaft belonging to an adjacent platform.

2. The platform of claim 1 wherein the sides of the frame are of rectangular shape and each side comprises a bearing for a pivot pin for receiving the articulation of the maneuvering jack and a bearing for a pivot pin for receiving articulation of the upright, these bearings being disposed substantially along two opposite angles of said sides.

3. The platform of claim 1 wherein said platform further comprises two lateral bracing uprights journalled on said principal upright, rollers provided in the end of each of the lateral bracing uprights, a support to receive pivoting mounting of the base of each lateral upright and slideways on said longitudinal beam, each slideway to receive a roller.

4. The platform of claim 1 wherein said platform comprises two driving units of opposite orientations and a jack of one transmission assembly comprises a right-handed endless screw and the jack of the other transmission assembly comprises a left-handed endless screw.

5. The platform of claim 1 wherein the longitudinal shaft comprises a revolution counter for monitoring and controlling displacement of the platform.

6. The platform of claim 1 wherein said platform further comprises a motor and transmission means between said motor and the longitudinal shaft, for actuation of the driving units.

7. The platform of claim 1, wherein it is constituted by a beam containing the said longitudinal shaft which extends over the whole length of the beam as well as the transverse shaft which, for its part, extends over the whole width of said beam, the longitudinal shaft being common to the two mechanical systems and allowing the juxtaposition and connection of a plurality of platforms together, so as to constitute a larger platform assembly, and, to that end, the longitudinal and transverse shafts respectively comprise connection means rendering them adapted to be connected to the corresponding shafts belonging to an adjacent platform.

8. A platform assembly of claim 7, wherein the said platforms are assembled together in a non-colinear configuration, the mechanical systems of each structure being connected together by at least one mechanical link forming angular transmission and constituted by two bevel pinions, each at the end of a shaft fast with one of the mobile structures, and disposed in non-colinear manner, the two bevel pinions being kinetically connected by an intermediate transmission bevel pinion, whose axis is at right angles to the plane defined by the two longitudinal shafts belonging to the drive assembled structures, said shafts being driven and driven, respectively.

9. The platform assembly of claim 8, wherein the platforms are driven in a synchronous movement and are located in a common horizontal upper plane, the platforms being provided to adopt in this plane different angular positions with respect to each other, and the platforms are kinetically connected together in their elevating and lowering movement by a mechanical link constituted by two bevel pinions, each at the end of a (longitudinal transverse) shaft fast with one of the platforms and these two pinions are kinetically connected by an intermediate bevel pinion of perpendicular axis.

10. The platform of claim 1, wherein it comprises, in addition to the principal upright manoeuvred by the jack, two lateral bracing uprights journaled at their centre on said central principal upright and each lateral upright is mounted to pivot by its base on a fixed lower support and its opposite end is adapted to slide along a slideway provided on the lateral edge of the box girder, this lateral upright thus being adapted to be displaced between a folded, horizontal position substantially parallel to the principal upright and an oblique, developed position, the principal upright and the two lateral uprights thus forming a deformable X.

11. The platform of claim 1, wherein the jacks of the mechanical systems comprise mechanical return means tensioned by the lowering of the bearing structure, the reserve of force accumulated in said mechanical system in lower position being restored during the elevating movement and working against gravity.

* * * * *